US007646366B2

(12) United States Patent
Ha et al.

(10) Patent No.: US 7,646,366 B2
(45) Date of Patent: Jan. 12, 2010

(54) DRIVING CURRENT OF ORGANIC LIGHT EMITTING DISPLAY AND METHOD OF DRIVING THE SAME

(75) Inventors: Yong Min Ha, Gumi-si (KR); Jung Chul Kim, Seoul (KR); Jin Huh, Gumi-si (KR)

(73) Assignee: LG. Display Co., Ltd., Seoul (KR)

( * ) Notice: Subject to any disclaimer, the term of this patent is extended or adjusted under 35 U.S.C. 154(b) by 620 days.

(21) Appl. No.: 11/167,866

(22) Filed: Jun. 27, 2005

(65) Prior Publication Data

US 2006/0022605 A1 Feb. 2, 2006

(30) Foreign Application Priority Data

Jul. 29, 2004 (KR) ..... 10-2004-0059608

(51) Int. Cl.
*G09G 3/32* (2006.01)

(52) U.S. Cl. ..... 345/82

(58) Field of Classification Search ..... 345/76, 345/77, 82, 83, 169.3; 327/108; 315/169.3
See application file for complete search history.

(56) References Cited

U.S. PATENT DOCUMENTS 6,392,617 B1 * 5/2002 Gleason ..... 345/82
7,015,884 B2 * 3/2006 Kwon ..... 345/78
7,184,014 B2 * 2/2007 Koyama et al. ..... 345/100
2001/0028226 A1 * 10/2001 Malaviya et al. ..... 315/169.3
2004/0061694 A1 * 4/2004 Noguchi et al. ..... 345/204
2005/0057455 A1 * 3/2005 Peng ..... 345/76
2005/0068271 A1 * 3/2005 Lo ..... 345/76
2006/0066251 A1 * 3/2006 Sim ..... 315/169.3
2007/0024541 A1 * 2/2007 Ryu et al. ..... 345/76

* cited by examiner

*Primary Examiner*—Chanh Nguyen
*Assistant Examiner*—Jonathan Blancha
(74) *Attorney, Agent, or Firm*—Brinks Hofer Gilson & Lione

(57) ABSTRACT

A driving circuit of an organic light emitting display includes: a first PMOS transistor turned on in response to a driving signal to transfer a data signal; an OLED (organic light emitting diode) where an amount of light emitted is controlled by a control current; a second PMOS transistor for supplying the control current to the OLED; a third PMOS transistor connected to a node to which the first and second PMOS transistors are connected; a first capacitor connected between the first PMOS transistor and the third PMOS transistor; and a second capacitor connected between the second PMOS transistor and the first PMOS transistor.

14 Claims, 5 Drawing Sheets

(a)

(b)

(a)

(b)

(a)

(b)

(a)

(b)

(a)

(b)

DRIVING CURRENT OF ORGANIC LIGHT EMITTING DISPLAY AND METHOD OF DRIVING THE SAME

This application claims the benefit of priority to Korean patent application No.: 2004-59608 which was filed on Jul. 29, 2004 and which is incorporated herein by reference.

TECHNICAL FIELD

The present application relates to an organic light emitting display, and more particularly, to a driving circuit of an organic light emitting display and a method of driving the same.

BACKGROUND

An organic electro-luminescence display or an organic light emitting display (OELD) generally refers to a flow of electricity in organic material and a light emitting process. The flow of electricity in organic material can be divided into a flow of electrons and a flow of holes. A semiconductor analysis method is generally used because a dominant flow is determined by molecular structures of organic materials.

That is, the flow of electrons or the flow of holes can be dominant according to the molecular structures. The light emitting process is associated with the motion of electrons within molecule. Electrons in the molecule can exhibit a specific energy state such as an excited state, so that electrons hold energy that can be emitted. One aspect of the emission of energy is the observation of light.

In development and application of the organic light emitting display, efficiency is important. Even though a high-brightness device can be fabricated, if the efficiency of the electric energy to optical energy conversion in the device is degraded, an actual application is difficult. Since the organic light emitting display has low power consumption, it is competitive in the markets. Thus, many developments of the organic light emitting display are in progress.

In the organic light emitting device, devices for representing red (R), green (G) and blue (B) colors are separately manufactured. Unlike a TFT-LCD, an organic light emitting device does not use a color filter. That is, RGB colors are reproduced using organic materials that exhibit colors with different brightness according to the applied voltages. Therefore, the organic light emitting device can display images on a screen without using a backlight and a color filter.

The organic materials exhibiting RGB colors have different characteristics according to the applied voltages. That is, brightness characteristics are different according to the applied voltages and efficiency is also different. A driving circuit of a related art organic light emitting display will be described below with reference to the accompanying drawings.

FIG. 1 is a circuit diagram of a driving circuit of a related art organic light emitting display.

Referring to FIG. 1, a PMOS transistor T1 serving as a switching element is arranged in a position where a gate line (GL) and a data line (DL)) are vertically intersected. A gate of the PMOS transistor T1 is electrically connected to the gate line, and a source of the PMOS transistor T1 is electrically connected to the data line.

A drain of the PMOS transistor T1 is electrically connected to a gate of the PMOS transistor T2 that controls a current flowing through an organic light emitting diode (OLED).

A power line arranged parallel to the data line is electrically connected to a source of the PMOS transistor T2. A capacitor Cst is connected between the source and the gate of the PMOS transistor T2 to store a data signal for 1 frame.

A drain of the PMOS transistor T2 is serially connected to one terminal the OLED and another terminal of the OLED is connected to ground.

When a driving signal is applied through the gate line GL, the PMOS transistor T1 connected to the gate line GL is turned on, and data signal is transferred from the source to the drain of the PMOS transistor T1.

Therefore, the data voltage is applied on a node X. Due to the data voltage, a gate-source voltage Vgs is generated in combination with a power supply voltage VDD connected to the source of the PMOS transistor T2 that controls the OLED. The PMOS transistor T2 is controlled by the gate-source voltage Vgs.

That is, while the data voltage Vdata applied to the gate of the PMOS transistor T2 and the power supply voltage VDD are charged in the capacitor Cst for 1 frame, the current flowing through the drain of the PMOS transistor T2 is controlled.

The driving current (I) flowing through the drain of the PMOS transistor T2 is given by a following Equation 1, which is the same equation as for a general field effect transistor (FET).

$$I=K(V_{gs}-V_{th})^2 \quad \text{(Equation 1)}$$

where $$K=\frac{1}{2}\mu Cox\left(\frac{W}{L}\right)$$

where μ is a mobility, Vth is a threshold voltage of the transistor T2, and Cox is an oxide capacitance, that is, a capacitance for unit area of the gate of the second transistor T2.

Accordingly, the driving current I flowing through the PMOS transistor T2 is controlled by the voltage gate-source voltage $V_{gs}$ and the power supply voltage VDD. The OLED is controlled by the driving current I.

The driving current of the OLED is derived from the power supply voltage VDD. Therefore, the number of pixels increases, a larger amount of current must be supplied.

For example, when a number of pixels N are provided in a row direction and a full white is driven, the power supply voltage VDD must supply a current ($NI_{pixel}$). A voltage drop occurs due to line resistance in the VDD supply line (V=IR). That is, the voltage drop in an n-th row is given by $$[N(N+1)/2]_{pixel}*I_{pixel}$$

where $R_{pixel}$ is a line resistance in each pixel and $I_{pixel}$ is a driving current.

Since the voltage Vgs of the thin film transistor disposed at each pixel is changed due to the voltage drop, a difference of the current in the OLED is caused, depending on the OLED location The difference of the current applied to the OLED is serious in the large-sized display, causing a non-uniformity of picture quality.

SUMMARY

An organic light emitting diode (OLED) is described in which when a power supply voltage (VDD) is supplied to each pixel through a power line, a gate-source voltage (Vgs) of a driving transistor is not associated with the power supply voltage (VDD) applied thereto, such that a current applied to an OLED is not changed due to voltage drop in the power supply line.

A driving circuit of an organic light emitting display includes: a first PMOS transistor turned on in response to a driving signal to transfer a data signal; an OLED (organic light emitting diode) of where an amount of light emitted therefrom is controlled by a control current; a second PMOS transistor for supplying a control current to the OLED; a first capacitor connected between the second PMOS transistor and the first PMOS transistor; a third PMOS transistor connected to a node to which the first PMOS transistor and first capacitor are connected; and a second capacitor connected between the first PMOS transistor and the third PMOS transistor;.

In another aspect, there is provided an organic light emitting display, including: a first NMOS transistor turned on in response to a driving signal to transfer a data signal; an OLED (organic light emitting diode) of where an amount of light emitted therefrom is controlled by a control current; a second NMOS transistor for supplying the control current to the OLED; a third NMOS transistor connected to the second NMOS transistor; a first capacitor connected between the first NMOS transistor and the third NMOS transistor; and a second capacitor connected between the second NMOS transistor and the first NMOS transistor.

In a further aspect, there is provided a method of driving a driving circuit of an organic light emitting display, the driving circuit including: a first PMOS transistor turned on in response to a driving signal to transfer a data signal; an OLED (organic light emitting diode) where an amount of light emitted therefrom is controlled by a control current; a second PMOS transistor for supplying a control current to the OLED; a second capacitor connected between the second PMOS transistor and the first PMOS transistor; a third PMOS transistor connected to a node to which the first PMOS transistor and first capacitor are connected; a second capacitor connected between the first PMOS transistor and the third PMOS transistor, wherein a gate-source voltage of the second PMOS transistor is comprised of a value of a data voltage function and the OLED is controlled using the gate-source voltage of the second PMOS transistor.

In yet another aspect, there is provided a method of driving a driving circuit of an organic light emitting display, the driving circuit including: a first NMOS transistor turned on in response to a driving signal to transfer a data signal; an OLED (organic light emitting diode) where an amount of light emitted therefrom is controlled by a control current; a second NMOS transistor for supplying the control current to the OLED; a third NMOS transistor connected to the second NMOS transistor; a first capacitor connected between the first NMOS transistor and the third NMOS transistor; and a second capacitor connected between the second NMOS transistor and the first NMOS transistor, wherein a gate-source voltage of the second NMOS transistor is comprised of a value of a data voltage function and the OLED is controlled using the gate-source voltage of the second NMOS transistor.

DETAILED DESCRIPTION

Exemplary embodiments may be better understood with reference to the drawings, but these embodiments are not intended to be of a limiting nature. Like numbered elements in the same or different drawings perform equivalent functions.

Figure 2:
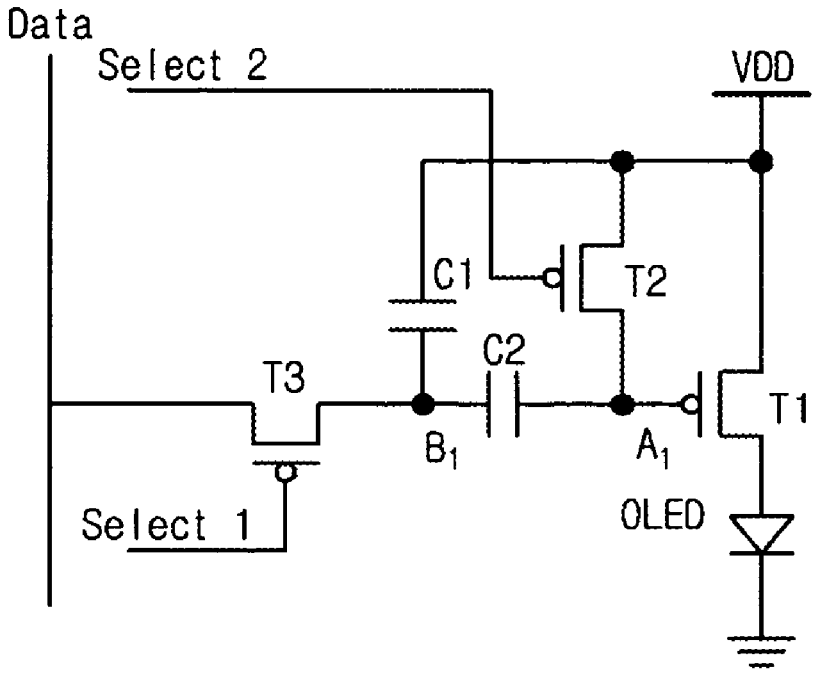
FIGS. 2*a* and 2*b* are views illustrating a driving circuit and a driving waveform of an organic light emitting display according to a first embodiment, respectively.
Figure 2:
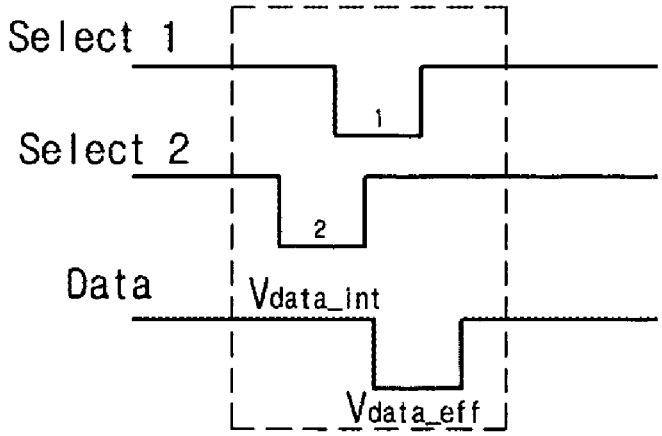

Referring to FIG. 2, a PMOS transistor T3 performs a switching operation to supply a data signal to a driving circuit of an organic light emitting display, and a PMOS transistor T1 serves as a driving element for controlling a current. An organic light emitting diode (OLED) generates light in accordance with a current controlled by the PMOS transistor T1. A capacitor C2 is connected between a gate of the PMOS transistor T1 and a drain of the PMOS transistor T3. A capacitor C1 is connected between the capacitor C2 and the PMOS transistor T3. A PMOS transistor T2 is connected to the gate of the PMOS transistor T1 and applies a power supply voltage VDD.

When a select driving signal Select 2 is applied to the gate of the PMOS transistor T2, the PMOS transistor T2 is turned on, and the power supply voltage VDD is applied through a source of the PMOS transistor T2 to a node A1, which is connected to the gate of the PMOS transistor T1, thereby initializing the node A1.

Then, a select driving signal Select 1 is applied to the gate of the PMOS transistor T3, and the PMOS transistor T3 is turned on. Accordingly, a node B1 is initialized to an initial data voltage Vdata_int.

That is, when both the PMOS transistors T2 and T3 are turned on in response to the select driving signals Select 2 and Select 1, the initial data voltage Vdata_int is applied to the node B1.

A voltage of the node A1 becomes VDD and a voltage of the node B1 becomes Vdata_int. Therefore, a voltage across the capacitor C2 becomes VDD-Vdata_int.

When the PMOS transistor T3 is in a turned-on state, if the PMOS transistor T2 is turned off in response to the select driving signal Select 2, an effective data voltage Vdata_eff is applied to the node B1 through the PMOS transistor T3.

The effective data voltage Vdata_eff applied to the node B1 is charged in the capacitor, so that the voltage of the node B1 is maintained at Vdata_eff.

Similarly, if the effective data voltage Vdata_eff is applied to the node B1, the voltage of the node A1 becomes Vdata_eff+VDD-Vdata_int (Vc2).

Then, if the PMOS transistor T3 is turned off, the voltage of the node B1 is maintained at Vdata_eff by the capacitor C1 and the voltage of the node A1 becomes Vdata_eff+VDD-Vdata_int.

Accordingly, a gate-source voltage Vgs of the PMOS transistor T1 for supplying a current to the OLED becomes Vdata_eff+VDD-Vdata_int−VDD.

Since a current I flowing through the drain of the PMOS transistor T1 is controlled by $I=K(V_{gs}-V_{th})^2$ $$\left(\text{where } K = \frac{1}{2}\mu Cox\left(\frac{W}{L}\right)\right), \quad \text{(Equation 1)}$$

a result can be expressed as $$\begin{aligned} I &= \frac{1}{2}K(|V_{gs}| - |V_{th}|)^2 \\ &= \frac{1}{2}K(|Vdata_{eff} + VDD - Vdata_{initial} - VDD| - |V_{th}|)^2 \\ &= \frac{1}{2}K(|\Delta Vdata| - |V_{th}|)^2 \end{aligned}$$

That is, the current flowing through the OLED can be controlled regardless of VDD. Even though a voltage drop occurs when the power supply voltage is applied along a power line, a constant current can be supplied.

Accordingly, when the power supply voltage is supplied along a row line, the gate-source voltage of the PMOS transistor T1 can be controlled regardless of VDD, even when different voltages are applied to each pixel due to the voltage drop. Thus, a constant current can be applied to the OLED.

Figure 3:
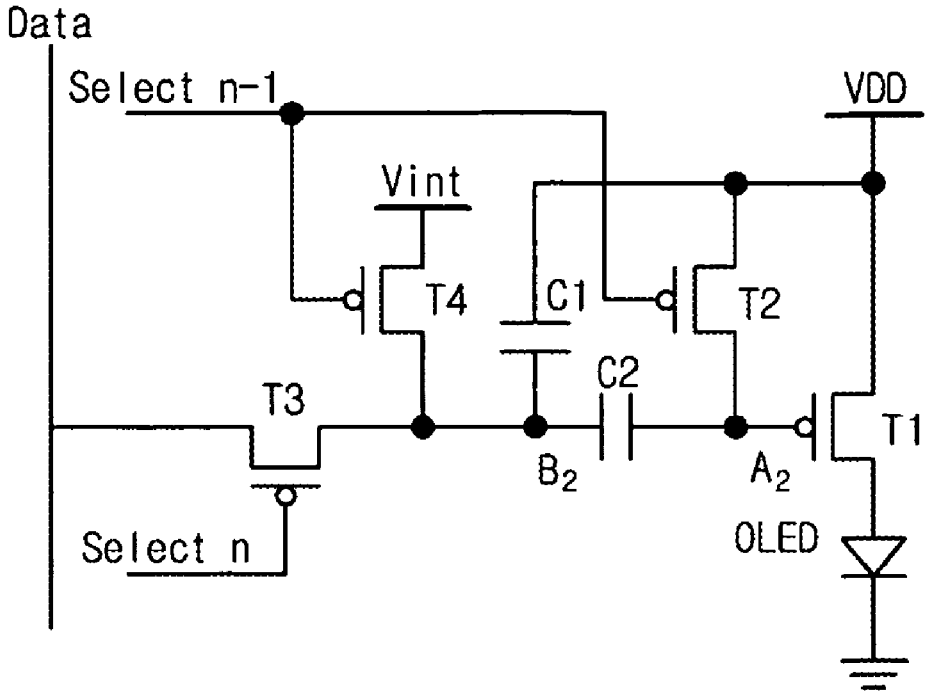
FIGS. 3*a* and 3*b* are views illustrating a driving circuit and a driving waveform of an organic light emitting display according to a second embodiment, respectively.
Figure 3:
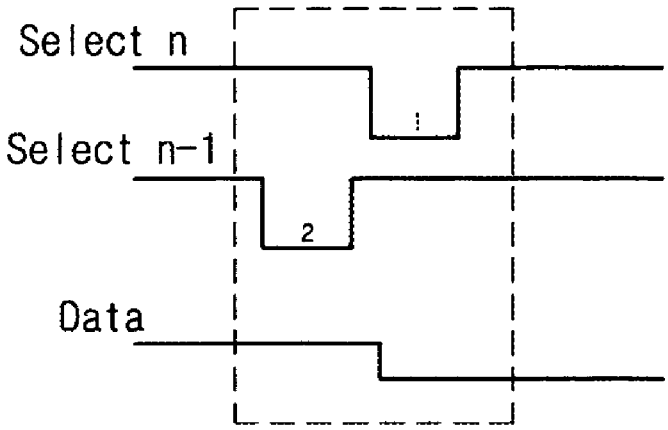

In another aspect, shown in FIG. 3, the voltage applied to the node B2 is supplied not from the data voltage but from an external power source.

A PMOS transistor T3 performs a switching operation to supply a data signal, and a PMOS transistor T1 serves as a driving element for controlling a current. An OLED generates light in accordance with a current controlled by the PMOS transistor T1. A capacitor C2 is connected between a gate of the PMOS transistor T1 and a drain of the PMOS transistor T3. A capacitor C1 is connected between the capacitor C2 and the PMOS transistor T3. A PMOS transistor T2 is connected to the gate of the PMOS transistor T1 and applies a power supply voltage VDD. Also, a PMOS transistor T4 is connected to the drain of the PMOS transistor T3 and applies an initialization voltage.

When a select driving signal Select n−1 is applied to the gate of the PMOS transistor T2, the PMOS transistors T2 and T4 are simultaneously turned on.

At this time, the power supply voltage VDD is applied through a source of the PMOS transistor T2 to a node A2, which is connected to the gate of the PMOS transistor T1, thereby initializing the node A2. The initialization voltage is applied to the node B2 through a source of the PMOS transistor T4 by the select driving signal Select n−1.

Accordingly, the initialization voltage of the node B2 is a turn-on voltage V_initial of the select driving voltage Select n−1, not the initial value Vdata_int of the data voltage as in FIG. 2.

At this time, a voltage of the node A2 becomes VDD and a voltage of the node B2 becomes V_int. Therefore, a voltage across the capacitor C2 becomes VDD-V_int.

When the PMOS transistor T3 is turned on in response to the select driving signal Select n, the select driving signal Select n−1 changes from a low level to a high level, so that the PMOS transistors T2 and T4 are turned-off.

An effective data voltage Vdata_eff is supplied to the node B2 by the turned-on PMOS transistor T3.

Accordingly, the effective data voltage Vdata_eff is applied through the PMOS transistor T3 to the node B2, so that the voltage of the node B2 becomes the effective data voltage Vdata_eff.

Also, the effective data voltage in the node B2 is charged in the capacitor C1, so that the voltage of the node B2 is maintained at Vdata_eff.

Thus, if the effective data voltage Vdata_eff is applied to the node B2, the voltage of the node A2 becomes Vdata_eff+VDD-V_int (Vc2).

When the PMOS transistor T3 is turned off, the voltage of the node B2 is maintained at Vdata_eff by the capacitor C1 and the voltage of the node A2 becomes Vdata_eff+VDD-V_int.

Accordingly, a gate-source voltage Vgs of the PMOS transistor T1 for supplying a current to the OLED becomes Vdata_eff+VDD-V_int−VDD.

Figure 1:
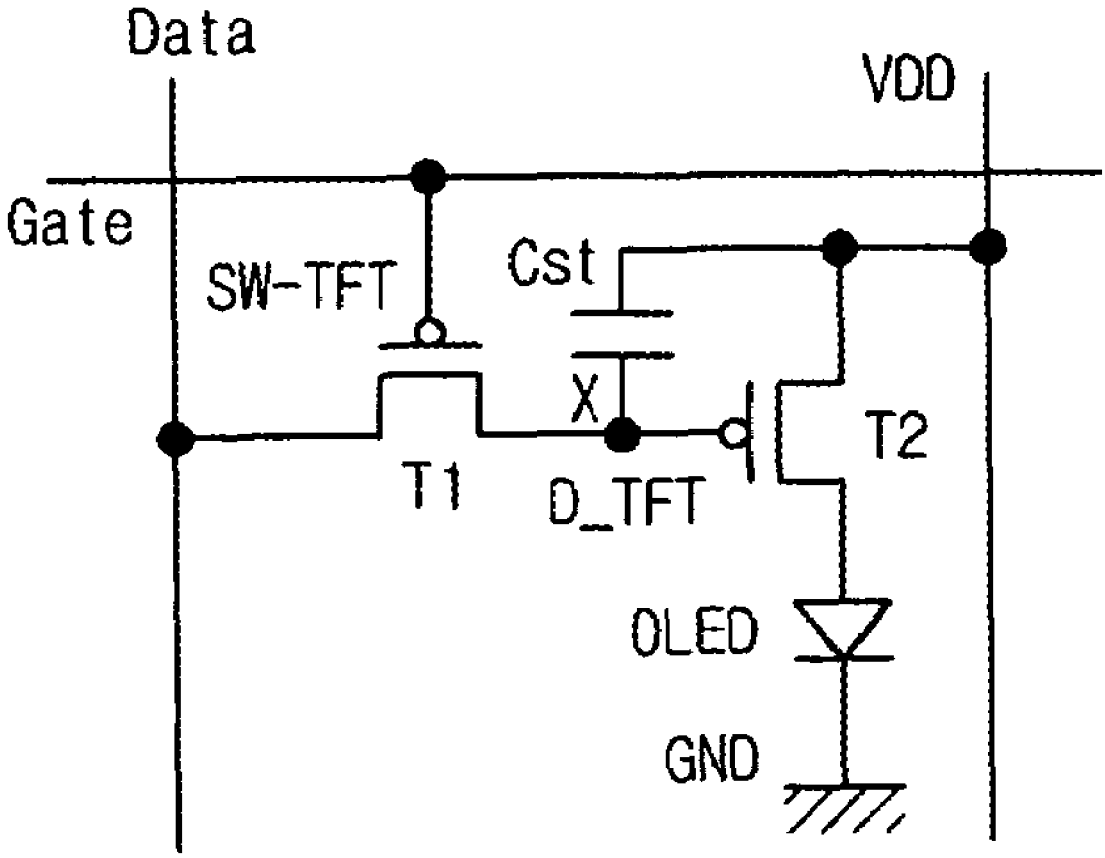
Fig.1 Related Art
FIG. 1 is a circuit diagram of a driving circuit for a related art organic light emitting display.

As described in FIG. 1, since a current I flowing through the drain of the PMOS transistor T1 is controlled by $I=K(V_{gs}-V_{th})^2$ $$\left(\text{where } K = \frac{1}{2}\mu Cox\left(\frac{W}{L}\right)\right),$$

a result can be expressed as $$\begin{aligned} I &= \frac{1}{2}K(|V_{gs}| - |V_{th}|)^2 \\ &= \frac{1}{2}K(|Vdata_{eff} + VDD - V_{initial} - VDD| - |V_{th}|)^2 \\ &= \frac{1}{2}K(|\Delta Vdata| - |V_{th}|)^2 \end{aligned}$$

That is, the current flowing through the OLED can be controlled regardless of VDD. Even though a voltage drop occurs when the power supply voltage is applied along a power line, a constant current can be supplied.

The select driving signal Select n−1 used as the initialization voltage V_int can be generated by a separate driving circuit or may be generated using a previous-stage gate signal.

Accordingly, when the power supply voltage is supplied along a row line, the gate-source voltage of the PMOS transistor T1 can be controlled regardless of VDD, even when different voltages are applied to each pixel due to the voltage drop. Thus, a constant current can be applied to the OLED.

Figure 4:
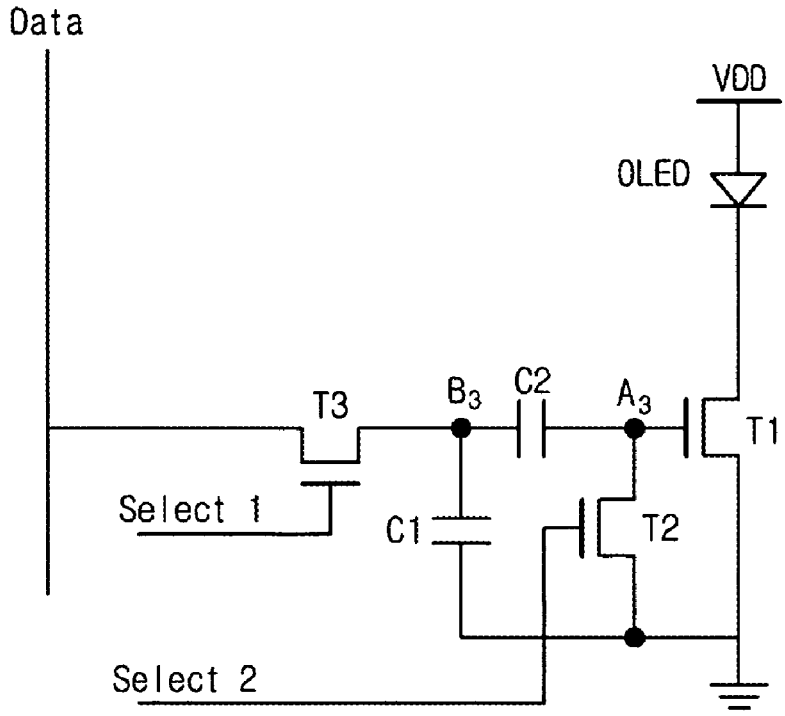
FIGS. 4*a* and 4*b* are views illustrating a driving circuit and a driving waveform of an organic light emitting display according to a third embodiment, respectively.
Figure 4:
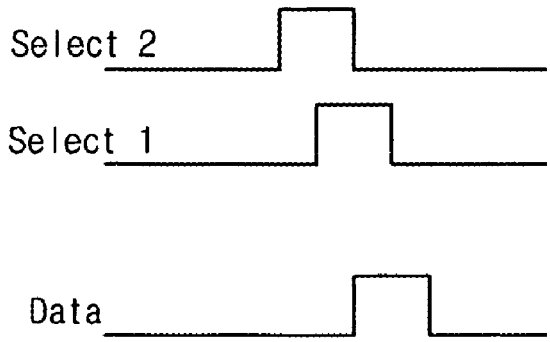

FIG. 4 is a circuit diagram of a driving circuit similar to that of FIG. 2, except that the PMOS transistors used as the switching element or the driving element are replaced with NMOS transistors.

The driving method of the organic light emitting display is similar to that of FIG. 2. The transistors are turned on by the select driving signal and the data signal that change from a low level to a high level.

An NMOS transistor T3 performs a switching operation to supply a data signal, and an NMOS transistor T1 serves as a driving element for controlling a current. An OLED generates light in accordance with a current controlled by the NMOS transistor T1. A capacitor C2 is connected between a gate of the NMOS transistor T1 and a drain of the NMOS transistor T3. A capacitor C1 is connected between the capacitor C2 and the NMOS transistor T3 and charges a data voltage. An NMOS transistor T2 is connected to the gate of the NMOS transistor T1 and applies a power supply voltage VDD.

As the operation of the driving circuit shown in FIG. 4 is substantially identical to that of FIG. 2, only differences in operation are described.

The OLED is connected to the power supply voltage VDD and generates light by the current control of the NMOS transistor T1.

The source of the NMOS transistor T1 is connected to ground.

Unlike in FIG. 2, a node B3 between the NMOS transistor T3 and the capacitor C2 is initialized to a low level (Vdata_int) by the data voltage, and then an effective data voltage Vdata_eff of a high level is applied.

When the select driving signal Select 2 is applied to the gate of the NMOS transistor T2, the NMOS transistor T2 is turned on. At this time, the power supply voltage VDD is applied through the source of the NMOS transistor T2 to a node A3, which is connected to the gate of the NMOS transistor T1.

Then, the select driving signal Select 1 is applied to the gate of the NMOS transistor T3 and the NMOS transistor T3 is turned on.

Thus, the node B3 is initialized to the initial value Vdata_int (low level) of the data voltage.

That is, when both the NMOS transistors T2 and T3 are turned on in response to the select driving signals Select 2 and Select 1, the initial voltage Vdata_int is applied to the node B3.

The subsequent driving process and effect are substantially identical to that of FIG. 2.

Figure 5:
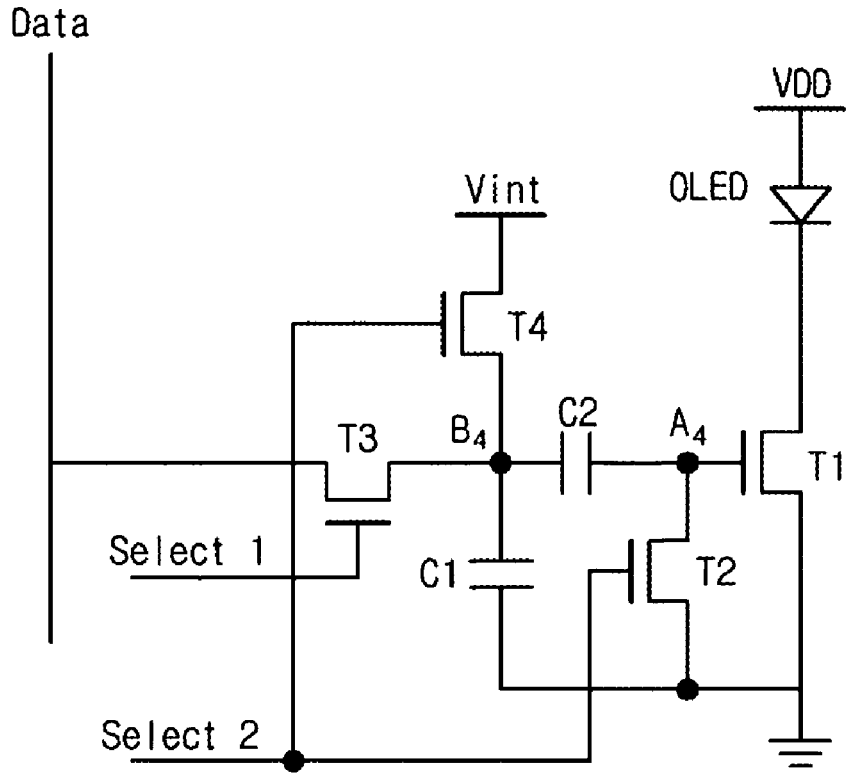
FIGS. 5*a* and 5*b* are views illustrating a driving circuit and a driving waveform of an organic light emitting display according to a fourth embodiment, respectively.
Figure 5:
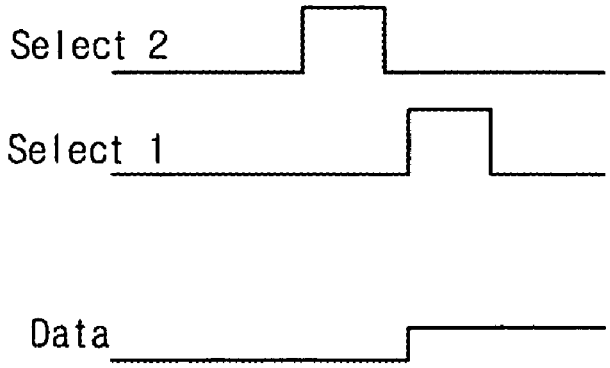

In a further aspect, in the driving circuit shown in FIG. 5, the voltage applied to the node B4 is supplied not from the data voltage but from an external power source.

An NMOS transistor T3 performs a switching operation to supply a data signal, and an NMOS transistor T1 serves as a driving element for controlling a current. An OLED generates light in accordance with a current controlled by the NMOS transistor T1. A capacitor C2 is connected between a gate of the NMOS transistor T1 and a drain of the NMOS transistor T3. A capacitor C1 is connected between the capacitor C2 and the NMOS transistor T3 and charges a data voltage. An NMOS transistor T2 is connected to the gate of the NMOS transistor T1 and applies a power supply voltage VDD. Also, an NMOS transistor T4 is connected to the drain of the NMOS transistor T3 and applies an initialization voltage.

The driving circuit shown in FIG. 5 has a similar operation and effect as the driving circuit shown in FIG. 3.

That is, the PMOS transistors of FIG. 3 are replaced with the NMOS transistors, and the driving signal changing from a low level to a high level is applied.

The period of the signals is corresponds to that of FIG. 3. When the power supply voltage is supplied to each pixel through the power line, it is possible to solve the problem that causes the current applied to the OLED to be un-uniform due to the voltage drop, which results from the resistive components of the line. When the power supply voltage VDD is supplied to each pixel through the power line, the gate-source voltage Vgs of the driving transistor is constant regardless of VDD, such that the current applied to the OLED is not changed due to the voltage drop. Consequently, the non-uniformity of picture quality can be solved.

Although the present invention has been explained by way of the examples described above, it should be understood to the ordinary skilled person in the art that the invention is not limited to the examples, but rather that various changes or modifications thereof are possible without departing from the spirit of the invention. Accordingly, the scope of the invention shall be determined only by the appended claims and their equivalents.

What is claimed is:

1. A driving circuit of an organic light emitting display, comprising:

a first PMOS transistor connected to a first node, the first PMOS transistor being turned on in response to a first driving signal to transfer a data signal;

an OLED of which an amount of light emission is controlled by a control current;

a second PMOS transistor connected to a second node, a line of power supply voltage and the OLED to supply the control current to the OLED;

a first capacitor connected between the first and second nodes;

a third PMOS transistor connected to the second node and the line of power supply voltage, the third PMOS transistor being turned on in response to a second driving signal to initialize the second node as a power supply voltage; and a second capacitor connected to the first node and the line of power supply voltage, wherein a power supply voltage included in the control current is compensated with the power supply voltage stored in the second node so that the control current is dependent on the data signal and a threshold voltage of the second PMOS transistor regardless of the power supply voltage, wherein the second and third PMOS transistors and the second capacitor is commonly connected to the line of power supply voltage, and wherein the data signal includes an initialization voltage and an effective data voltage to sequentially be supplied to the first node while the first PMOS transistor is turned on.

2. The driving circuit according to claim 1, further comprising a fourth PMOS transistor connected to the first node, the fourth PMOS transistor being turned on in response to the second driving signal to initialize the first node as a initialization voltage, wherein the third and fourth PMOS transistors are simultaneously turned on in response to the second driving signal.

3. The driving circuit according to claim 2, wherein the fourth PMOS transistor has a gate commonly connected to a gate of the third PMOS transistor.

4. The driving circuit according to claim 1, wherein a voltage difference function of the data signal comprises a difference between a gate voltage and a source voltage of the second PMOS transistor and the voltage difference function controls a current of the second PMOS transistor.

5. The driving circuit according to claim 1, wherein a current flowing through a drain of the second PMOS transistor is controlled by a voltage difference of the data signal and a threshold voltage of the second PMOS transistor.

6. A driving circuit of an organic light emitting display, comprising:

a first NMOS transistor connected to a first node, the first NMOS transistor being turned on in response to a first driving signal to transfer a data signal;

an OLED of which an amount of light emission is controlled by a control current;

a second NMOS transistor connected to a second node, a line of power supply voltage and the OLED to supply the control current to the OLED;

a third NMOS transistor connected to the second node and the line of power supply voltage, the third NMOS transistor being turned on in response to a second driving signal to initialize the second node as a power supply voltage;

a first capacitor connected between the first and second nodes; and a second capacitor connected to the first node and the line of power supply voltage, wherein a power supply voltage included in the control current is compensated with the power supply voltage stored in the second node so that the control current is dependent on the data signal and a threshold voltage of the second NMOS transistor regardless of the power supply voltage, wherein the second and third NMOS transistors and the second capacitor is commonly connected to the line of power supply voltage, and wherein the data signal includes an initialization voltage and an effective data voltage to sequentially be supplied to the first node while the first NMOS transistor is turned on.

7. The driving circuit according to claim 6, further comprising a fourth NMOS transistor connected to the first node, the fourth transistor being turned on in response to the second driving signal to initialize the first node as a initialization voltage, wherein the third and fourth NMOS transistors are simultaneously turned on in response to the second driving signal.

8. The driving circuit according to claim 6, wherein the fourth NMOS transistor has a gate commonly connected to a gate of the third NMOS transistor.

9. The driving circuit according to claim 6, wherein a difference between a gate voltage and a source voltage of the second NMOS transistor is given by only a voltage difference of the data signal, and a current flowing through the second NMOS transistor is controlled by the voltage difference.

10. The driving circuit according to claim 6, wherein a current flowing through a drain of the second NMOS transistor is controlled by a voltage difference of the data signal and a threshold voltage of the second NMOS transistor.

11. A method of driving an organic light emitting display, the method comprising:

turning on a first PMOS transistor connected to a first node in response to a first driving signal to transfer a data signal;

connecting a first capacitor between the first node and a second node;

connecting a second PMOS transistor to the second node, a line of power supply voltage and an OLED to supply a control current to the OLED;

connecting a third PMOS transistor to the second node and the line of power supply voltage, the third PMOS transistor being turned on in response to a second driving signal to initialize the second node as a power supply voltage;

connecting a second capacitor between the first node and the line of power supply voltage; and supplying the control current to the OLED by the second PMOS transistor, wherein a gate-source voltage of the second PMOS transistor is comprised of a value of a data voltage function, wherein a power supply voltage included in the control current is compensated with the power supply voltage stored in the second node so that the control current is dependent on the data signal and a threshold voltage of the second PMOS transistor regardless of the power supply voltage, wherein the second and third PMOS transistors and the second capacitor is commonly connected to the line of power supply voltage, and wherein the data signal includes an initialization voltage and an effective data voltage to sequentially be supplied to the first node while the first PMOS transistor is turned on.

12. The method according to claim 11, wherein a light output of the OLED is controlled by a current, and wherein the current is independent of the power supply voltage.

13. A method of driving an organic light emitting display, the method comprising:

turning on a first NMOS transistor connected to a first node in response to a first driving signal to transfer a data signal;

connecting a second NMOS transistor to a second node, a line of power supply voltage and an OLED to supply a control current to the OLED;

supplying a control current to the OLED by a second NMOS transistor connecting a third NMOS transistor to the second node and the line of power supply voltage, the third NMOS transistor being turned on in response to a second driving signal to initialize the second node as a power supply voltage;

connecting a first capacitor between the first and second nodes;

connecting a second capacitor between the first node and the line of power supply voltage;

forming a gate-source voltage of the second NMOS transistor comprising of a value of a data voltage function; and controlling a light emission of the OLED by a control current wherein a power supply voltage included in the control current is compensated with the power supply voltage stored in the second node so that the control current is dependent on the data signal and a threshold voltage of the second NMOS transistor regardless of the power supply voltage, wherein the second and third NMOS transistors and the second capacitor is commonly connected to the line of power supply voltage, and wherein the data signal includes an initialization voltage and an effective data voltage to sequentially be supplied to the first node while the first NMOS transistor is turned on.

14. The method according to claim 13, wherein the control current is independent of the power supply voltage.

* * * * *

UNITED STATES PATENT AND TRADEMARK OFFICE

CERTIFICATE OF CORRECTION

PATENT NO. : 7,646,366 B2
APPLICATION NO. : 11/167866
DATED : January 12, 2010
INVENTOR(S) : Ha et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 811 days.

Signed and Sealed this

Sixteenth Day of November, 2010

David J. Kappos

David J. Kappos
*Director of the United States Patent and Trademark Office*